US005118039A

United States Patent [19]

Williams, Jr.

[11] Patent Number: 5,118,039

[45] Date of Patent: Jun. 2, 1992

[54] DOMESTIC HOT WATER HEATING CONTROL CIRCUIT FOR FURNACE CONTROL SYSTEMS

[75] Inventor: Roger W. Williams, Jr., Springfield, Mass.

[73] Assignee: R. E. Phelon Company, Inc., East Longmeadow, Mass.

[21] Appl. No.: 582,371

[22] Filed: Sep. 14, 1990

[51] Int. Cl.[5] ..... F24H 3/06

[52] U.S. Cl. ..... 237/7; 237/8 R; 237/19

[58] Field of Search ..... 237/8 R, 8 A, 8 B, 7, 237/19; 236/11, 46 E, 46 F

[56] References Cited

U.S. PATENT DOCUMENTS 4,907,737 3/1990 Williams, Jr. ..... 236/11

4,978,063 12/1990 Chase ..... 237/8 R

*Primary Examiner*—Henry A. Bennet

*Attorney, Agent, or Firm*—Chapin, Neal & Dempsey

[57] ABSTRACT

Domestic hot water heating control circuit is used in conjunction with a furnace control unit of a hot air furnace system which utilizes a hot water heat exchanger. The hot water control circuit has a diverter valve which is electrically connected to a thermostat which monitors a hot water tank and a fan control circuit for controlling the operation of a comfort fan for the hot air system integrated with the furnace control system. The diverter valve controls the circulation of heated water between the heat exchanger of the furnace and the hot water tank. When the hot water tank thermostat calls for heat, the diverter valve switches a relay to start the furnace and to direct heated water from the heat exchanger of the furnace to the heating coil of the hot water tank. The fan control circuit then operates to shut "off" the comfort fan to prevent cold air from being supplied to the living space in the event that the space thermostat calls for heat.

5 Claims, 2 Drawing Sheets

DOMESTIC HOT WATER HEATING CONTROL CIRCUIT FOR FURNACE CONTROL SYSTEMS

BACKGROUND OF THE INVENTION

This invention relates to solid-state electronic control systems for furnaces and, more particularly, to such control systems which include a means for heating the water in domestic hot water tanks.

In U.S. Pat. No. 4,907,737, I disclosed an ELECTRONIC CONTROL SYSTEM FOR A GAS-FIRED/HOT AIR FURNACE WITH INDUCED DRAFT BLOWER which regulates heating and cooling of a space and monitors the furnace for excessive temperatures. This furnace control system does not, however, provide means for diverting heated water from the heat exchanger in the furnace to the heating coil of a separate hot water heater.

While it has generally been considered desirable to utilize the heated water from the heat exchanger of a hot air furnace system to heat the water in a domestic hot water heater, this arrangement has certain drawbacks related to the generally, limited heating capacity of the furnace. In this connection, when the water from the heat exchanger of the furnace is directed to the heating coil of the hot water tank, to avoid sending out cool air from the furnace when the space thermostat calls for heat, the comfort fan must be cut "off".

In the past, a circuit for shutting "off" the comfort fan would have generally included a normally "closed" relay switch connected in a series circuit with the fan so that when the hot water tank called for heat, the comfort fan would be cut "off". The coil of the relay is connected to a temperature switch disposed to sense the temperature of the water in the hot water tank and is adapted to open when heat is required. In addition, a temperature switch is provided on the heat exchanger for the furnace so that the comfort fan will not start until the heat exchanger reaches a sufficiently high temperature to heat the furnace air for circulation to the heated space. One of the drawbacks of this circuit was that it required two separate temperature operated switches, and an additional relay with normally closed contacts.

Accordingly, the principal object of this invention is to provide an improved control circuit to be integrated with a solid state furnace control system used in combination with a hot air furnace with a hot water heat exchanger and a hot water supply heater.

Another object of this invention, in an improved control circuit of the above type, is to eliminate the need for a second temperature switch and an additional relay for controlling the operation of the comfort fan.

The above and other objects of this invention will be more readily apparent from the following description read in conjunction with the accompanying drawings in which.

Figure 1:
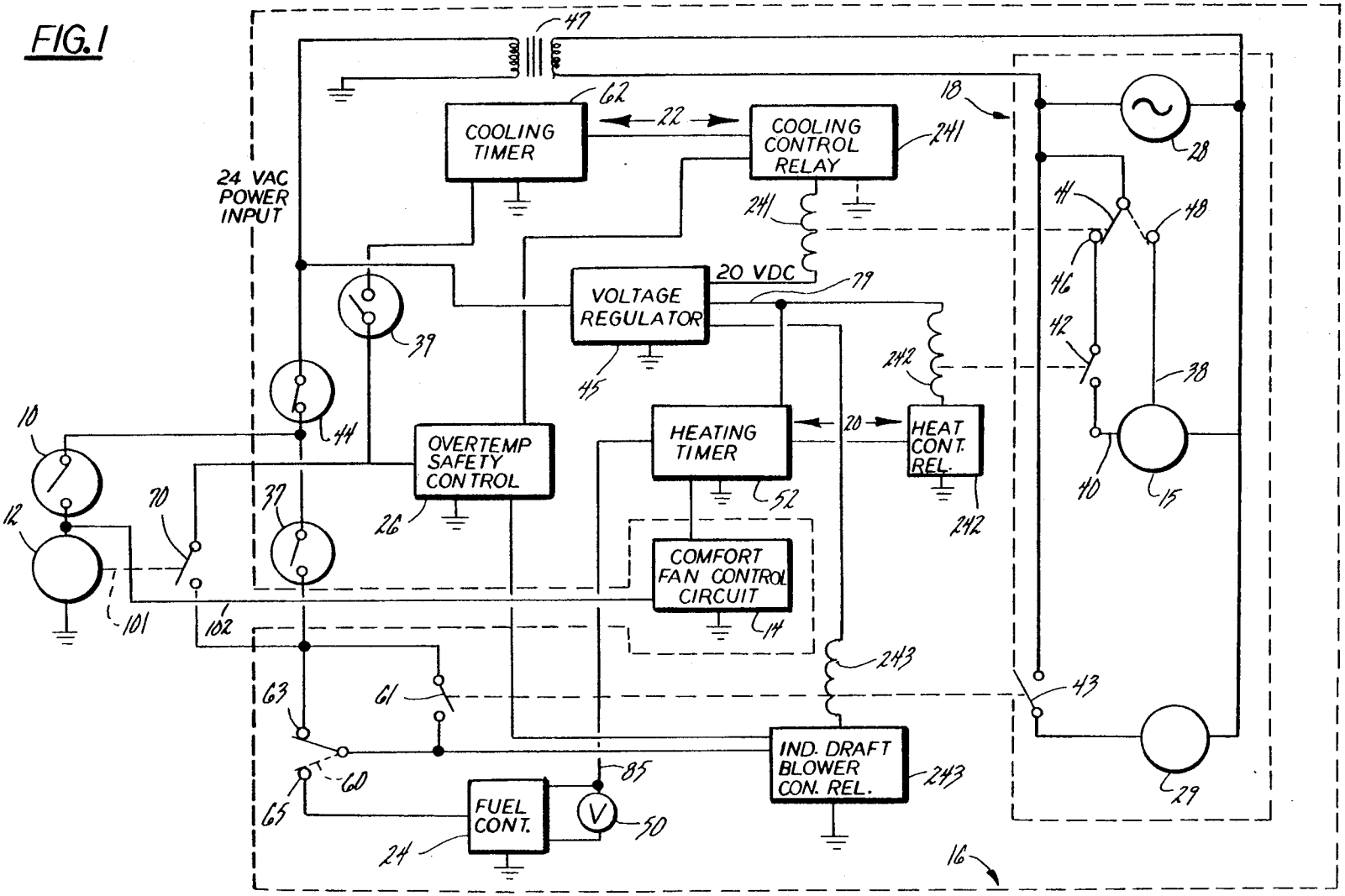
FIG. 1 is a block diagram illustrating an electronic furnace control system including a hot water heating control circuit of the type embodying this invention.
Figure 2:
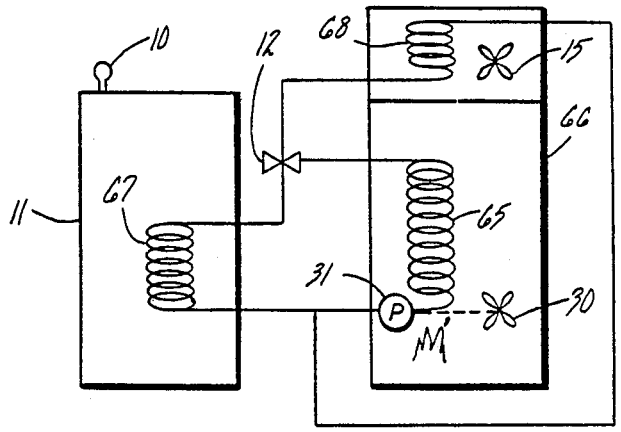
FIG. 2 is a plan view of the boiler water circulation system.

A hot water heating control circuit for furnace control systems is shown generally in FIG. 1 and includes thermostat 10 for sensing the water temperature of a hot water heater 11 (FIG. 2), a diverter valve 12, a control circuit 14 for a comfort fan 15 and a furnace control circuit 16. The furnace control circuit 16 may be the same as is shown in my U.S. Pat. No. 4,907,737 and includes a power supply circuit 18, a heating control 20, a cooling control 22, a fuel or burner control 24 and an overtemperature safety control 26. The furnace control 16 provides for operation of the furnace system, for the heating and cooling of a living space or other area and to prevent excessively high temperatures of the furnace or boiler 66. The power supply circuit 18 comprises a suitable power source 28, such as 120 volts alternating current (VAC) connected, in parallel, to an electric motor 29 and a comfort fan 15. The motor 29 operates an induced draft blower 30 and a water pump or circulator 31 (FIG. 2). The blower 30 supplies air into the combustion chamber of the furnace 66 for combustion with a fuel, such as natural gas and the pump 31 serves to supply heated water from heat exchanger 65 in the furnace to air heating coil 68 and a heat exchanger coil 67 in the hot water heater 11. The motor 29 is also connected in series with a relay switch or contact 43 which is operated by a relay control 243 for the blower 30 and circulator pump 31. The fuel or burner control 24 controls the operation of a fuel valve 50 for providing the fuel to the furnace 66 and one such burner control adaptable for use in practicing this invention, is Model No. S86H 1006 marketed by Minneapolis Honeywell.

The comfort fan 15 (FIGS. 1 and 2) draws air through a heat exchanger 68, heated by boiler water from the furnace 66. Air drawn over the heated coil 68 by the comfort fan 15 will be heated before being supplied to the space monitored by a heating thermostat 37 and a cooling thermostat 39. The comfort fan 15 includes high and low speed windings, energized respectively by two switch contacts 41 and 42 connected to conductors 38 and 40. Contact 41 is normally engaged with terminal 46 and is operated by the cooling circuit 22. When the contact 41 is switched to engage terminal 48, the high speed winding is energized for supplying denser, cool air to the living space in response to the cooling thermostat 39. Switch 42 is disposed normally "open" and is operated by heating circuit 20. In response to a call for heat by thermostat 37, switch contact 42 will be "closed" by relay 242 and the low speed windings of comfort fan 15 are energized by conductor 40 whereby less dense, heated air is moved by the comfort fan 15. Voltage regulator 45 provides 20 VDC to operate relays 241, 242 and 243 which control the high and low speed operation of the comfort fan 15 and the motor 29 which drives blower 30 and pump 31 (FIG. 2).

Burner control 24, relay 242, a heating timer 52 and airflow switch 60 make up the heating circuit 20. Timer 52 delays the energization of relay control 242 after boiler 66 is "fired up" to prevent the comfort fan 15 from immediately blowing cold air into the living space when heat is called for, but the furnace is not yet up to temperature. Airflow switch 60 is pneumatically operated and is normally disposed in the upper position against terminal pin 63 and, when lowered, will energize the burner control 24. When the heating thermostat 37 "closes", electrical energy is supplied through airflow switch 60 to the relay control 243 which is energized, thereby starting the motor 29 which operates the induced draft blower 30 and the circulator pump 31. At the same time, relay 243 also "closes" relay switch or contact 61. When the induced draft blower 30 is turned "on", pneumatic switch 60 will be shifted by a change in air pressure to its lower position against pin 65 and the burner control 24 will be energized through contact 61 which provides power from transformer 47 to the fuel valve 50 and the heating timer 52.

The cooling relay control 22 includes a cooling timer 62 which is energized when the cooling thermostat 39 closes. The timer 62 provides a delay before the cooling relay control 241 is activated and once activated, the high speed windings of the comfort fan 15 are energized by conductor 38 to supply cool air to the space or area monitored by the thermostat 39.

The overtemperature safety control 26 is connected in series with a normally "closed" thermostatic switch 44 disposed to sense the operating temperature of the furnace 66. A first output of control 26 is connected to the cooling control relay 241 which controls the high speed operation of the comfort fan 15. A second output is connected to the induced draft blower control relay 243. Should the temperature of the furnace 66 rise to an unsafe level, the temperature switch 44 will "open", thereby deenergizing the safety control 26 and, in turn, shutting down the circulator relay 243 and induced draft blower motor 29. As a result, the movable element of the air switch will shift to its upper position and the burner control 24 will be shut down, thereby cutting off fuel to the furnace. At the same time, the high speed windings of the comfort fan 15 will be energized by relay 241 to dissipate the excessive heat from the furnace 66.

The improvement of the furnace control circuit 16 comprises the hot water heating control system which includes the hot water tank thermostat 10, the diverter valve 12 and the comfort fan control circuit 14. The thermostat 10 is connected to 24 VAC provided by step down transformer 47 to the diverter valve 12 and to the comfort fan control circuit 14. When the water tank thermostat 10 "closes", power is supplied to the diverter valve 12 and comfort fan control circuit 14. The valve 12 routes furnace water through the heating coil 67 of the water tank 11 and relay 101 (FIG. 1) causes an auxillary contact 70 to be closed which, by providing a parallel path thereto, simulates the closing of the heating thermostat 37. The motor 29 which drives the induced draft blower and the circulator pump 31, is thus energized and fuel is supplied to the furnace by fuel control 24. Comfort fan control circuit 14 cuts "off" the comfort fan 15 by preventing the heating timer 52 from running which thereby inhibits the flow of cold air into the space being monitored by thermostat 37.

Figure 3:
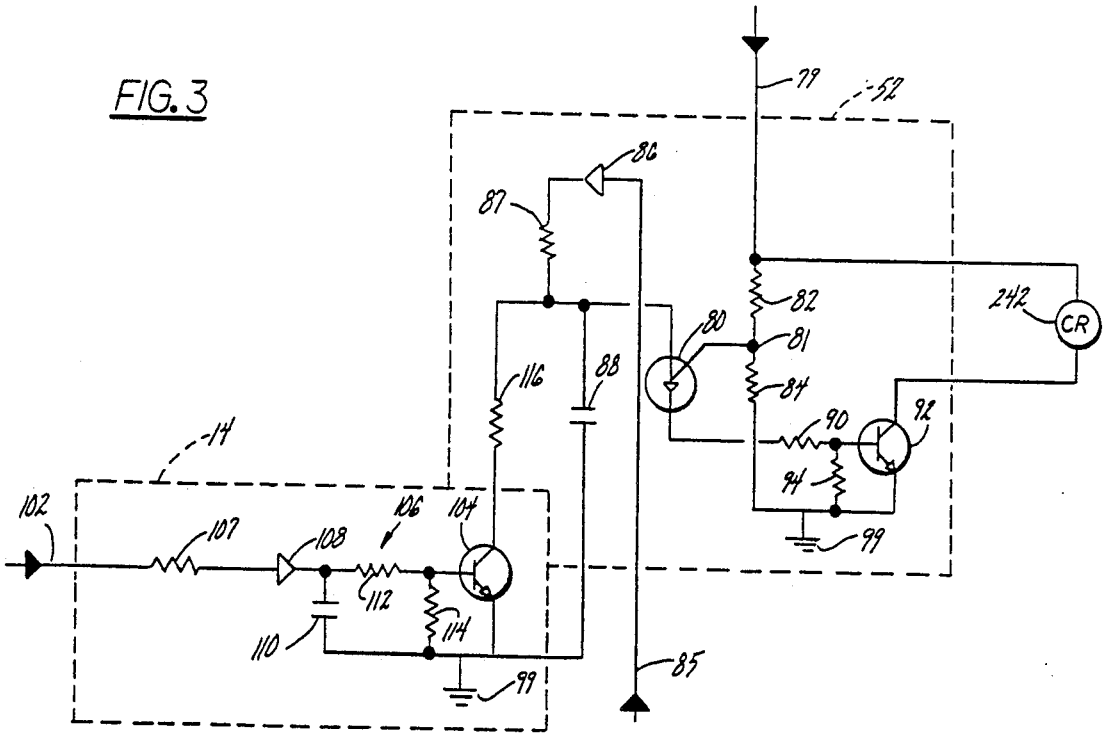
FIG. 3 is a schematic wiring diagram showing, in greater detail, elements of the furnace control system and hot water heating control circuit of FIG. 1.

As illustrated in greater detail in FIG. 3, the heating timer 52 includes a 20 VDC input lead 79 from the voltage regulator 45 and a programmable unijunctional transistor (PUT) 80. Lead 79 conducts power to relay control 242 and to a voltage divider composed of resistor 82 and resistor 84. The program electrode of the PUT 80 is connected to a junction 81 between resistors 82 and 84. Lead 85 connects the fuel valve 50 (FIG. 1) to a diode 86 in series with resistor 87 connected to resistor 116, capacitor 88 and to the annode of the PUT 80. The cathode of the PUT 80 is in series with a resistor 90 and the base of a transistor 92 which, when conducting, energizes relay control 242. A resistor 94 is also connected across the base and emitter electrodes of transistor 92 to reduce the current thereto. The collector of the transistor 92 is connected in series with the relay control 242 and the emitter is connected to ground 99.

The fan control circuit 14, which operates the comfort fan 15, is connected by lead 102 to the switched side of the water tank thermostat 10 and includes a transistor 104 and a rectifying circuit 106. The rectifying circuit 106 provides a DC voltage to the base of transistor 104 and includes a resistor 107 in series with a diode 108 and a capacitor 110, connected across the base and emitter electrodes of transistor 104. Two resistors 112 and 114 are also provided as a voltage divider network for reducing the current to the base of transistor 104. The collector of transistor 104 is connected to a resistor 116 and to the ungrounded side of capacitor 88. The emitter of transistor 104 is connected to ground 99.

OPERATION

In referring generally to FIGS. 2 and 3, heated water from the heat exchanger 65 may be supplied by pump 31 either to heat exchanger 68 or the hot water tank 11. When furnace 66 is running, water in the heat exchanger 65 is heated and pumped by pump 31 to the diverter valve 12 where it is directed through the heat exchanger 68 and back to the boiler 66. With the comfort fan 15 running, the air is heated by heat exchanger 68 and supplied to the living space monitored by thermostat 37. Whenever the thermostat 10 for the hot water tank 11 calls for heat, furnace water is routed by the diverter valve 12 from the boiler 66 to the heating coil 67 of the water tank 11. At the same time, the comfort fan 15 will be turned "off".

During normal operation of the boiler 66 for heating the living space as when the thermostat 37 calls for heat, the burner control 24 (FIG. 1) is energized to operate the fuel valve 50 and charge capacitor 88 (FIG. 3). At the same time, the program electrode of the PUT 80 is energized by conductor 79 from the voltage regulator 45. As capacitor 88 is charged, the voltage rises at the annode of PUT 80 which provides a time-delay before conduction occurs from the anode to the cathode of PUT 80. Once the PUT 80 conducts, power is provided to the base of transistor 92 which turns "on" transistor 92 and energizes relay control 242, thereby also turning "on" the comfort fan 15 (FIGS. 1 and 2). When the temperature rises above that set on the thermostat 37, it "opens" and thereby shuts "off" the furnace.

When the hot water thermostat 10 (FIGS. 1 and 2) calls for heat, energy is conducted to the diverter valve 12 which directs boiler water through the heat exchanger 67 of the water tank 11. Relay 101 then closes the auxiliary switch 70 and the furnace 66 is started. Once the thermostat 10 closes, energy is also conducted to the base of transistor 104 (FIG. 3) which turns same "on". When transistor 104 is conducting, the capacitor 88 will discharge to ground 99 whereby comfort fan 15 will be prevented from starting because the bias voltage or PUT 80 provided by capacitor 88 will have been dissipated or shunted to ground by transistor 104. Thus, the transistor 92 will be turned "off" and the comfort fan de-energized.

Having thus described by invention, what is claimed is:

1. In a hot air furnace which employs a hot water heater exchanger in combination with a hot water heater, a power source which provides electrical energy to a heating control circuit including a timing means with a time-delay feature for energizing a comfort fan to supply heated air to a living space, an induced draft blower which is adapted to supply air into the combustion chamber of the furnace, a pump which circulates water heated in the heat exchanger disposed in the combustion chamber of the furnace to a second heat exchanger adapted to heat the air drawn thereover by the comfort fan in response to a thermostat in the living space, a burner control which is energized in response to the induced draft blower, the improvement comprising a temperature sensing switch disposed to sense the termperature of the water in the hot water heater which is adapted to be energized by said power source, a diverter valve operable in response to the temperature switch for directing the flow of heated water from the second heat exchanger and through a heater coil in the hot water heater, and a means responsive to the temperature switch for deenergizing the timing means to prevent the "turn on" of the comfort fan when the hot water heater is calling for heat.

2. In a hot air furnace control system, as set forth in claim 1, wherein said diverter valve is adapted to effect operation of an auxiliary switch for simulating operation of the space thermostat.

3. In a hot air furnace control system, as set forth in claim 1, wherein said timing means includes a capacitor which is charged in response to the energization of a fuel valve of the burner control and a first electronic switch means connected to said capacitor to provide a discharge path to energize the comfort fan.

4. In a hot air furnace control system, as set forth in claim 3, wherein said means responsive to the hot water tank includes a second electronic switch means connected to receive energy from said temperature switch and from said capacitor, said second electronic switch means adapted to shunt energy from said first electronic switch means upon receiving energy from said temperature switch and thereby prevent the comfort fan from running.

5. In a hot air furnace control system, as set forth in claim 3, wherein said first electronic switch means includes a programmable unijunctional transistor.

* * * * *